US008961442B2

(12) United States Patent
Galvez Campos

(10) Patent No.: US 8,961,442 B2
(45) Date of Patent: Feb. 24, 2015

(54) DEVICE FOR MASSAGING THE FINGERS

(76) Inventor: JoséLuis Galvez Campos, Saragossa (ES)

( * ) Notice: Subject to any disclaimer, the term of this patent is extended or adjusted under 35 U.S.C. 154(b) by 1189 days.

(21) Appl. No.: 12/687,434

(22) Filed: Jan. 14, 2010

(65) Prior Publication Data

US 2010/0185128 A1 Jul. 22, 2010

(30) Foreign Application Priority Data

Jan. 16, 2009 (ES) ..... 200900120

(51) Int. Cl.

| | |
|---|---|
| ***A61H 15/00*** | (2006.01) |
| ***A61H 1/02*** | (2006.01) |
| *A61H 7/00* | (2006.01) |
| *A61H 19/00* | (2006.01) |

(52) U.S. Cl.

CPC ..... *A61H 1/0288* (2013.01); *A61H 15/0092* (2013.01); *A61H 2015/0057* (2013.01); *A61H 2205/067* (2013.01)

USPC ..... 601/125; 601/135; 601/127

(58) Field of Classification Search

CPC ..... A61H 1/00; A61H 1/0288; A61H 2201/0153; A61H 2201/0157; A61H 7/00; A61H 7/007; A61H 2205/067; A61H 15/00; A61H 15/0092; A61H 2015/00; A61H 2015/0007; A61H 2015/0014

USPC ..... 601/133–135, 40, 84, 23, 33, 5, 125, 601/120, 127; 484/124, 44, 47–49; 602/22; 482/124, 44, 47–49

See application file for complete search history.

(56) References Cited

U.S. PATENT DOCUMENTS

| | | | | |
|---|---|---|---|---|
| 1,327,466 | A * | 1/1920 | Fitzgerald | 601/93 |
| 2,310,804 | A * | 2/1943 | Morrison | 601/125 |
| 7,896,824 | B2 * | 3/2011 | Gueret | 601/127 |
| 2007/0179411 | A1 * | 8/2007 | Galvez Campos | 601/29 |

FOREIGN PATENT DOCUMENTS

| | | | |
|---|---|---|---|
| FR | 618121 C | * | 6/1926 |
| FR | 618121 C | * | 3/1927 |
| FR | 2282855 A1 | * | 3/1976 |

OTHER PUBLICATIONS

Grossi—FR618121A with Machine Translation acquired on Oct. 8, 2013; patent published on Jun. 25, 1926.*

* cited by examiner

*Primary Examiner* — Bhisma Mehta
*Assistant Examiner* — Jenna Zhang
(74) *Attorney, Agent, or Firm* — Wenderoth, Lind & Ponack, L.L.P.

(57) ABSTRACT

Device for massaging the fingers, useful for being used, mainly, by those people suffering from an articular degenerative disease, such as arthrosis, or inflammation of the joints, such as arthritis, to activate the blood circulation in a passive way favoring the nutrients arrival to the affected joints and removal of waste substances that cause pain and inflammation of the joints, the device (1) being defined by a central body (2), of generally cylindrical shape, provided with a threaded central axial hole (7), which by one of its bases embodies a grasp handle (8), while presenting on its opposite base, at least, two radial protrusions (9) to which respective arms (3) are, rotatably joined, which, on one of their ends, are restrained by a spring (4) and on their other free end mount respective rotating wheels (5).

14 Claims, 3 Drawing Sheets

DEVICE FOR MASSAGING THE FINGERS

OBJECT OF THE INVENTION

The following invention, according to the statement expressed in this specification, relates to a device for massaging the fingers, being useful to be used, mainly, by those people suffering from an articular degenerative disease, such as arthrosis, or inflammation of the joints, such as arthritis, intended for activating the blood circulation in a passive way favoring the nutrients arrival to the affected joints and removal of waste substances that cause pain and inflammation of the joints.

FIELD OF APPLICATION

In the present specification a device for massaging the fingers is described, which is of special application for those people suffering from an articular degenerative disease, such as arthrosis or chronic inflammation of the joints, such as occurs with arthritis.

BACKGROUND OF THE INVENTION

As it is known, arthrosis is an articular degenerative disease suffered by, mainly, middle age and elderly people, affecting the lumbar region, the neck, the knees, the hip and finger joints.

Arthrosis follows when degeneration of articular cartilage happens; whose degeneration may be caused by multiple causes and it is detected with the emergence of pain in the joints.

On the other hand, arthritis occurs as the chronic inflammation of a joint causing pain and implies a limitation of movements.

In both cases, when occurring in the joints of the fingers, the disease produces a deformation of the fingers which implies a functional impairment according to the degree of deformation.

Likewise, both diseases are treated, with the object of relieving their effects, with pharmacological and non-pharmacological measures, so that the pharmacological measures are based on taking analgesics and anti-inflammatories, while the non-pharmacological measures are based on, among others, performing physical exercise which improves blood circulation, as well as massaging.

Thus, exercise, walking or stretching, favors the remineralization and increases the blood circulation in the bones, while massaging the affected area activates circulation in a passive way favoring the nutrients arrival to the affected joints and, moreover, causes removal of waste substances that cause pain and inflammation.

DESCRIPTION OF THE INVENTION

In the present specification a device for massaging the fingers is described, being useful to be used, mainly, by those people suffering from an articular degenerative disease, such as arthrosis, or an inflammation of the joints, such as arthritis, intended for activating the blood circulation in a passive way favoring the nutrients arrival to the affected joints and removal of waste substances that cause pain and inflammation of the joints, such that the device is defined by a central body, of generally cylindrical shape, provided with a threaded central axial hole, which by one of its bases embodies a grasp handle, while presenting on its opposite base, at least, two radial protrusions, to said radial protrusions respective arms are rotatably joined, such that the almost parallel arms, by one of their ends, are restrained by a spring and on their other free end mount respective rotating wheels.

The central body, lacking the handle, may be coupled, through the external base of its threaded central axial hole to an actuation mechanical element.

Likewise, a protective element may be coupled to the central body, through the internal base of its threaded central axial hole, allowing avoiding possible hits in the tip of the finger to be massaged.

The arms, almost parallel to each other, are defined by a "U" section profile and are rotatably joined to the corresponding radial protrusion in proximity to one of their ends which is restrained by a spring.

Thus, the end of the arms close to the axis, located between the wings of the "U" section outline making up the arms, rotatably joined to the corresponding radial protrusion of the central body is solid and present a through hole, with respect to its core, with a more external span threaded, wherein a threaded rod threads and an internal span wherein a spring is located through the internal end of which is housed, and running into a blind hole of the central body.

Thus, the pressure of the spring located in the hole through the internal end of which is housed, running into the blind hole of the central body and through the external end of the hole running into the threaded rod, is regulated by a positional adjusting nut of the rod. This allows to bring closer, or move further away, the opposite free end of the arms in order to position them according to the thickness of the finger to be massaged.

Moreover, the rotating wheels with respect to the axis located between the wings of the outline making up the arms present a curve-concave contact external surface with the finger, allowing a perfect adaptation to the contour of the finger to favor the action of the massage.

In order to complement the description that will be made in the following, and with the object of helping to a better understanding of the characteristics of the invention, the present specification is accompanied by a set of planes, in which figures are represented, in an illustrative but not limiting manner, the most characteristic details of the invention.

DESCRIPTION OF A PREFERRED EMBODIMENT

Figure 1:
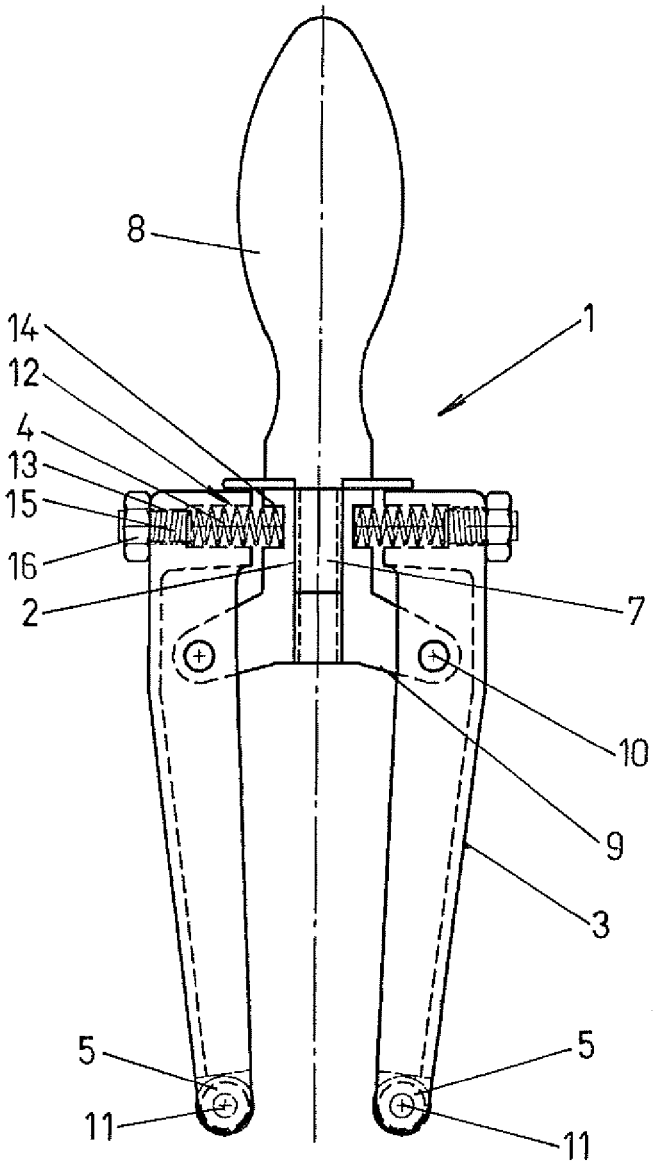
FIG. 1. Shows an elevational side view of a device for massaging the fingers, wherein it can be observed how the same is defined by a base body provided with a grasp handle, two arms rotatably joined to the base body, which by one of their ends are restrained by a spring and by their opposite end mount respective rotating wheels acting on the fingers.
Figure 2:
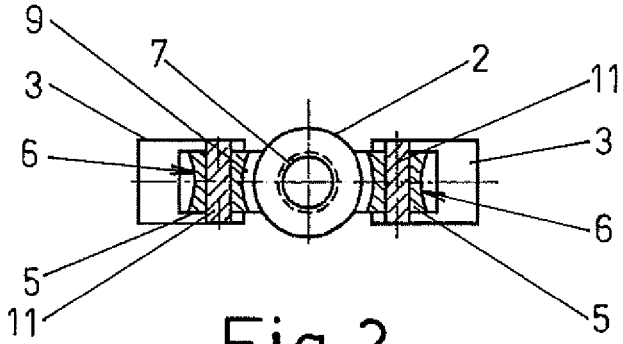
FIG. 2. Shows a bottom plant view of the device of the previous figure, wherein it can be observed how the base body presents axial and centrally a threaded hole and how the rotating wheels acting on the fingers present a curve-concave contact external surface to adapt to them.

In view of the mentioned figures and according to the numerals adopted we can observe how the device 1 for massaging the fingers consists of a central body 2 provided with a grasp handle 8 and, at least, two arms 3, almost parallel to each other, rotatably joined thereto, such that, said arms 3, by one of their ends are restrained by a spring 4 and on their opposite free end mount a rotating wheel 5, with regard to an axis 11, of curve-concave external surface 6 contacting the fingers.

The central body 2 presents a generally cylindrical shape with a threaded central axial hole 7, preferably according to two distinguished spans, incorporating on one of its bases the grasp handle 8, as such, while on its opposite base presents, at least, two radial protrusions 9 to which respective arms 3 will rotatably join. Logically, the base body 2 may present any other configuration, and, thus, may present a polygonal shape.

On the other hand, the arms 3 present a "U" general section such that the corresponding radial protrusion 9, to which they rotatably join by the axis 10, such as it is observed in FIG. 1, is between their wings. The rotating joint of the arm 3 to the corresponding radial protrusion 9 of the central body 2 is carried out in proximity to one of its ends.

Such as we have stated, the arms 3 are restrained, with regard to the end close to their rotating joint to the corresponding radial protrusion 9 of the central body 2, through a spring 4, such that, for that purpose, the end of the arm 3 close to its rotating joint to the radial protrusion 9 is solid and presents a through hole 12 with respect to its core in an orthogonal position to the turning axis 10, presenting an external span 13 thereof threaded and in whose through hole 12 a spring 4 is located, that, on one of its ends is housed and runs into a blind hole 14 of the central body 2, while on its other end runs into a threaded screw 15 in the external span 13 of the through hole 12.

In this way, through threading or unthreading the screw 15 by means of the nut 16, the adjustment of the relative positioning of the free ends of the arms 3 will be allowed with the object of adapting it to the thickness of the fingers to be massaged and adjusting the gentle pressure to be applied.

It will be allowed, through the central axial hole 7 to the central body 2, on the interior part, to place a protective stop 17 to prevent that the tip of the massaged finger 18 might be hit and, on the exterior part, it will be allowed, once the handle 8 has been removed, to adjust it to an automatic actuating element.

Figure 3:
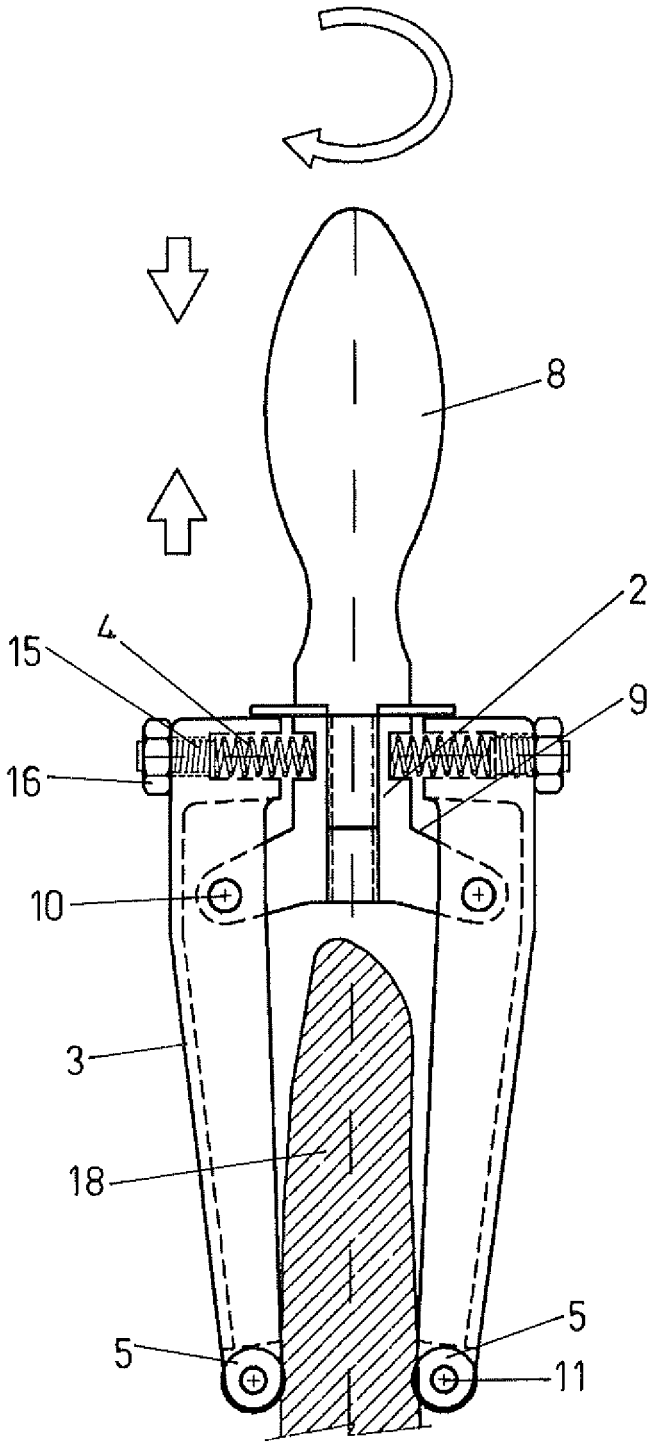
FIG. 3. Shows an elevational side view of a device for massaging the fingers, wherein it can be observed how it acts on a finger contacting the rotating wheels, with a gentle pressure, and that, with the displacement of the device, will cause the massage along the finger.

According to FIG. 3 of the drawings we can observe how in order to massage a finger 18 it will be enough to place it between the arms 3 and move the device 1 along thereof rotating it to massage the finger throughout its surface. In this way, the user himself can hold the device 1 by the handle 8 and move it along the finger 18 to be massaged, and at the same time being able to rotate the device 1 to cover the whole surface of the finger.

Figure 6:
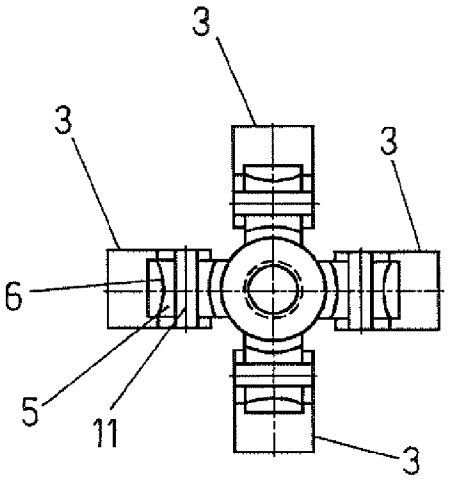
FIG. 6. Shows a bottom plant view of the device, according to a practical implementation variant, wherein it can be observed how it presents four arms rotatably joined to the base body and provided with the corresponding rotating wheel acting on the fingers.
Figure 5:
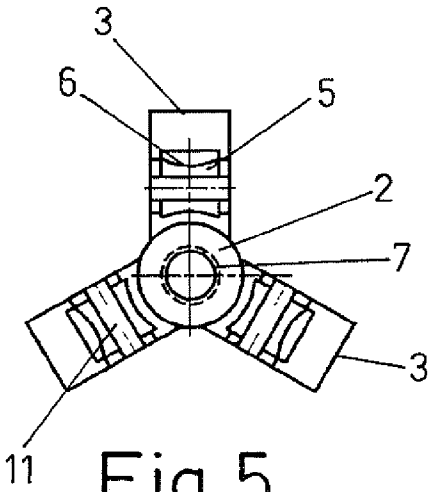
FIG. 5. Shows a bottom plant view of a device, according to a practical execution variant, wherein it can be observed how it presents three arms rotatably joined to the base body and provided with the corresponding rotating wheel acting on the fingers.
Figure 4:
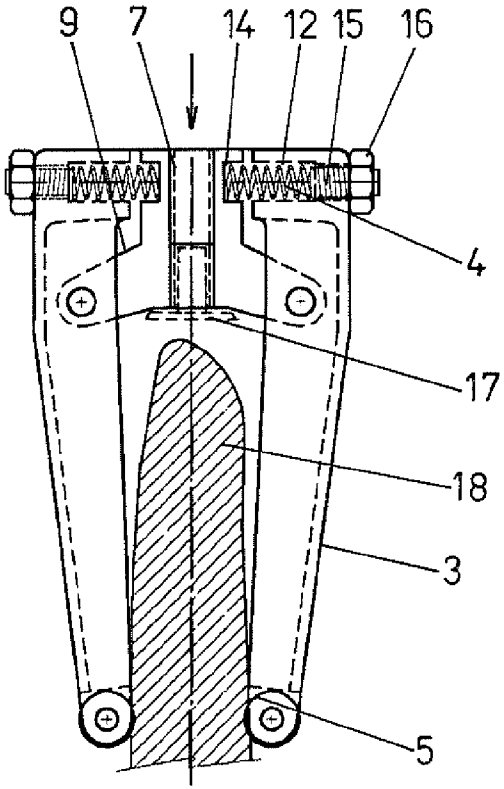
FIG. 4. Shows an elevational side view of a device for massaging the fingers, which device lacks the handle to be able to be coupled to a mechanical element through a span of its axial thread, wherein it can be observed how it acts on a finger contacting the rotating wheels, with a gentle pressure, while in the central axial thread span a protective padded body is coupled.

Logically, the number of arms 3 shall be variable and, thus, in a preferred embodiment of the invention the device 1 will have two arms 3, although according to different practical implementation variants the device 1 shall present three or four arms 3, such as it is shown in FIGS. 5 and 6 of the drawings. The arms 3 will be essentially mounted on a parallel position with each other, being able to adjust the gentle pressure to be applied to the fingers to be massaged.

Thus, those people suffering from an articular degenerative disease, such as arthrosis, or an inflammation of the joints, such as arthritis, when massaging the fingers by means of the device 1 will manage to activate the blood circulation in a passive way favoring the nutrients arrival to the affected joints and removal of waste substances that cause pain and inflammation of the joints, such that in a short time frame will notice an important improvement.

The invention claimed is:

1. A device for massaging the fingers, for use, mainly, by those people suffering from an articular degenerative disease, such as arthrosis, or an inflammation of the joints, such as arthritis, intended for activating the blood circulation in a passive way favoring the nutrients arrival to the affected joints and removal of waste substances that cause pain and inflammation of the joints, wherein the device comprises:

- a central body, of generally cylindrical shape, provided with a threaded central axial hole, and having opposite bases;
- a grasp handle attached to one of the bases of said central body, said grasp handle configured for actuating the device with a longitudinal movement with respect to the fingers;
- at least two radial protrusions, attached to the other base of said central body;
- one arm rotatably joined to each of the at least two radial protrusions, each of the arms having a base end and a free end opposite to the base end, the free ends of the arms being placed at a distance less than a distance corresponding to a thickness of the fingers;
- a rotating wheels mounted on the free ends of each of the arms;
- one spring restraining each of the base ends of the arms with one end of the spring abutting against the central body and another end of the spring abutting against the respective arm, wherein each of the springs is arranged to perpendicularly actuate the respective arm with respect to the longitudinal axis of the respective arm for massaging the fingers when the fingers are introduced through the free ends of the arms; and
- wherein the base ends of the arms are close to rotatable joints, respectively, that join the arms to the respective radial protrusions of the central body, each of the arms having a U-shaped cross-section including wings, and each of the rotatable joints being located between the wings of the U-shaped cross section of a respective one of the arms, each of the base ends of the arms being solid and having a through hole, each through hole having a threaded span near an exterior opening thereof of the through hole to engage threads of a threaded rod, wherein each through hole has an internal span in which the spring restraining the base end of the respective arm is located, and wherein each through hole has an internal end.

2. The device for massaging the fingers, according to claim 1, further comprising positional adjusting nuts, each of the positional adjusting nuts being threaded onto one of the threaded rods, such that the pressure exerted by each of the springs is adjusted by the respective positional adjusting nut.

3. The device for massaging the fingers, according to claim 1, wherein the rotating wheels each present a curve-concave external surface for contacting the finger with respect to an axis located between the wings of the U-shaped cross section of each of the arms.

4. The device for massaging the fingers, according to claim 1, wherein the central body is configured to be coupled, through an external base of the threaded central axial hole, to an actuation mechanical element.

5. The device for massaging the fingers, according to claim 1, wherein to the central body is coupled, through an internal base of the threaded central axial hole, a protective element.

6. A device for massaging the fingers, for use, mainly, by those people suffering from an articular degenerative disease, such as arthrosis, or an inflammation of the joints, such as arthritis, intended for activating the blood circulation in a passive way favoring the nutrients arrival to the affected joints and removal of waste substances that cause pain and inflammation of the joints, wherein the device comprises:

a central body, of generally cylindrical shape, provided with a threaded central axial hole, and having opposite bases;

a grasp handle attached to one of the bases of said central body, said grasp handle configured for actuating the device with a longitudinal movement with respect to the fingers;

at least two radial protrusions, attached to the other base of said central body;

one arm rotatably joined to each of the at least two radial protrusions, each of the arms having a base end and a free end opposite to the base end, the free ends of the arms being placed at a distance less than a distance corresponding to a thickness of the fingers;

a rotating wheels mounted on the free ends of each of the arms;

one spring restraining each of the base ends of the arms with one end of the spring abutting against the central body and another end of the spring abutting against the respective arm, wherein each of the springs is arranged to perpendicularly actuate the respective arm with respect to the longitudinal axis of the respective arm for massaging the fingers when the fingers are introduced through the free ends of the arms;

wherein the arms, almost parallel with each other, are each defined by a U-shaped section profile, and the arms are rotatably joined to the respective radial protrusions in proximity to the respective free ends of the arms, and wherein the base ends of the arms are close to rotatable joints, respectively, that join the arms to the respective radial protrusion of the central body, each of the arms having a U-shaped cross-section including wings, and each of the rotatable joints being located between the wings of the U-shaped cross section of a respective one of the arms, each of the base ends of the arms being solid and having a through hole, wherein each through hole has a threaded span near an exterior opening of the through hole to engage threads of a threaded rod, wherein each through hole has an internal span in which the spring restraining the base end of the respective arm is located, and wherein each through hole has an internal end.

7. The device for massaging the fingers, according to claim 6, further comprising positional adjusting nuts, each of the positional adjusting nuts are threaded onto one of the threaded rods, such that the pressure exerted by each of the springs is adjusted by the respective positional adjusting nut.

8. The device for massaging the fingers, according to claim 6, wherein the central body is configured to be coupled, through an external base of the threaded central axial hole, to an actuation mechanical element.

9. The device for massaging the fingers, according to claim 6, wherein to the central body is coupled, through an internal base of the threaded central axial hole, a protective element.

10. The device for massaging the fingers, according to claim 6, wherein the rotating wheels each present a curve-concave external surface for contacting the finger with respect to an axis located between wings of the "U" section profile of each of the arms.

11. A device for massaging the fingers, for use, mainly, by those people suffering from an articular degenerative disease, such as arthrosis, or an inflammation of the joints, such as arthritis, intended for activating the blood circulation in a passive way favoring the nutrients arrival to the affected joints and removal of waste substances that cause pain and inflammation of the joints, wherein the device comprises:

a central body, of generally cylindrical shape, provided with a threaded central axial hole, and having opposite bases;

a grasp handle attached to one of the bases of said central body, said grasp handle configured for actuating the device with a longitudinal movement with respect to the fingers;

three radial protrusions, attached to the other base of said central body;

three arms rotatably joined to the three radial protrusions, respectively, each of the arms having a base end and a free end opposite to the base end, the free ends of the arms being placed at a distance less than a distance corresponding to a thickness of the fingers;

a rotating wheels mounted on the free ends of each of the arms;

one spring restraining each of the base ends of the arms with one end of the spring abutting against the central body and another end of the spring butting against the respective arm, wherein each of the springs is arranged to perpendicularly actuate the respective arm with respect to the longitudinal axis of the respective arm for massaging the fingers when the fingers are introduced through the free ends of the arms.

12. The device for massaging the fingers, according to claim 11, wherein the central body is configured to be coupled, through an external base of the threaded central axial hole, to an actuation mechanical element.

13. The device for massaging the fingers, according to claim 11, wherein to the central body is coupled, through an internal base of the threaded central axial hole, a protective element.

14. The device for massaging the fingers, according to claim 11, wherein the rotating wheels each present a curve-concave external surface for contacting the finger with respect to an axis located between the wings of the U-shaped cross section of each of the arms.

* * * * *